US005090601A

United States Patent [19]

Thanisch

[11] Patent Number: 5,090,601

[45] Date of Patent: Feb. 25, 1992

[54] CONTAINER CLOSURE WITH A RETRACTABLE TURNSPOUT

[75] Inventor: Klaus J. Thanisch, Zell/Mosel, Fed. Rep. of Germany

[73] Assignee: Zeller Plastik GmbH, Zell/Mosel, Fed. Rep. of Germany

[21] Appl. No.: 455,366

[22] PCT Filed: Jul. 16, 1988

[86] PCT No.: PCT/EP88/00643

§ 371 Date: Mar. 12, 1990

§ 102(e) Date: Mar. 12, 1990

[87] PCT Pub. No.: WO89/00958

PCT Pub. Date: Feb. 9, 1989

[30] Foreign Application Priority Data

Dec. 29, 1987 [EP] European Pat. Off. ..... 87119298

[51] Int. Cl.[5] ..... B67D 3/00

[52] U.S. Cl. ..... 222/507; 222/536; 222/538; 222/541

[58] Field of Search ..... 222/507, 508, 530, 533-536, 222/538, 541, 542, 553, 153, 206, 211, 212, 215

[56] References Cited

U.S. PATENT DOCUMENTS

| | | | |
|---|---|---|---|
| 2,903,168 | 9/1959 | Sutliffe | 222/553 |
| 2,924,393 | 2/1960 | Robert | 222/553 X |
| 3,094,255 | 6/1963 | Hunter | 222/507 |
| 3,371,827 | 3/1968 | Micallef | 222/507 |
| 3,847,313 | 11/1974 | Micallef | 222/507 |
| 4,013,200 | 3/1977 | Tripp | 222/536 X |
| 4,779,773 | 10/1988 | Bennett | 222/507 |
| 4,836,423 | 6/1989 | Hayes et al. | 222/508 X |
| 4,852,762 | 8/1989 | Chou-Sheng | 222/507 X |
| 4,998,649 | 3/1991 | Thanisch | 222/507 |

FOREIGN PATENT DOCUMENTS

| | | | |
|---|---|---|---|
| 2104496 | 3/1983 | United Kingdom . | |
| 2112761 | 7/1983 | United Kingdom | 222/561 |
| WO87/06503 | 11/1987 | World Int. Prop. O. | 222/530 |

*Primary Examiner*—Kevin P. Shaver
*Attorney, Agent, or Firm*—Kane, Dalsimer, Sullivan, Kurucz, Levy, Eisele and Richard

[57] ABSTRACT

This invention relates to a closure for a container such as a bottle having mouth, the closure including a closure plug fit into the mouth, a plug with a turnspout and a shield disposed on the plug. A cap is fitted on the plug and has a lateral opening through which the turnspout can pass in an operational position. When the turnspout is in a closed position, the shield closes the lateral opening.

9 Claims, 7 Drawing Sheets

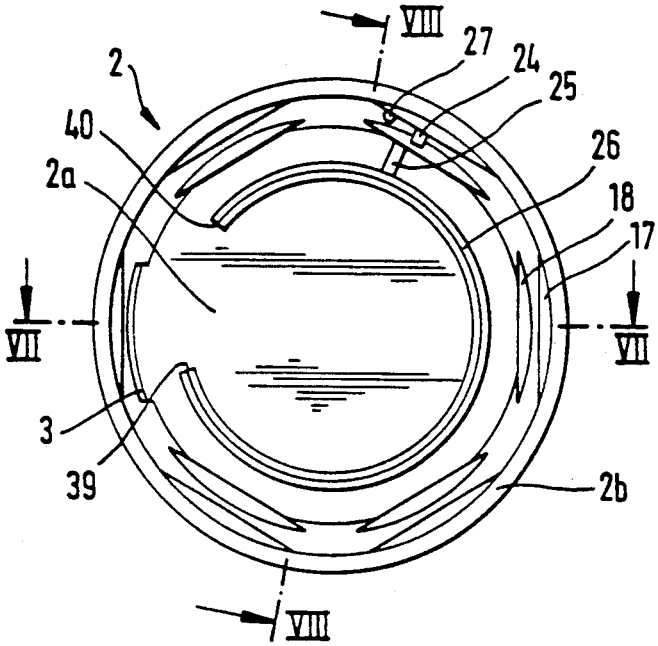
FIG.6
FIG.7
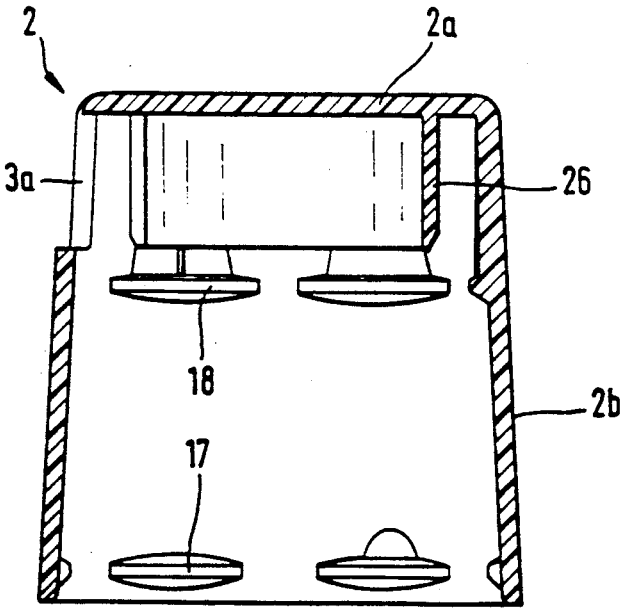
FIG.8
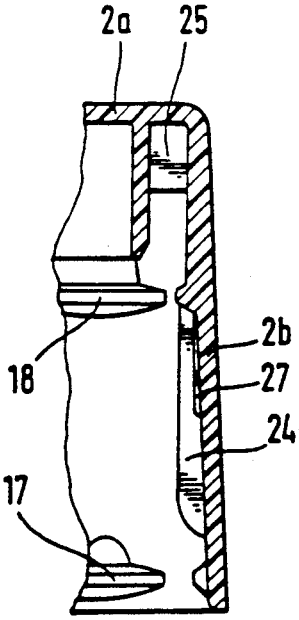

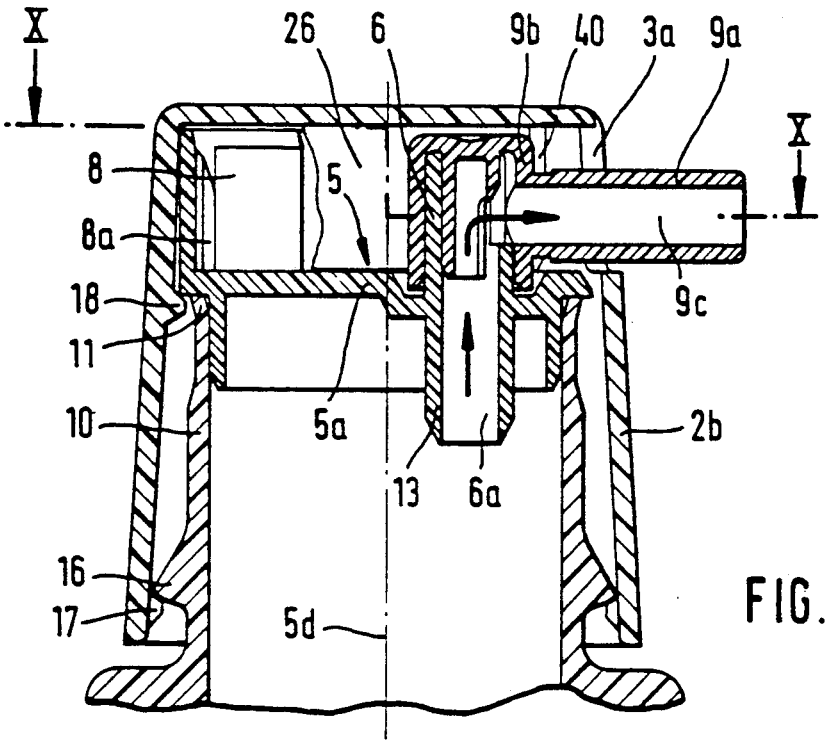
FIG.9
FIG.10
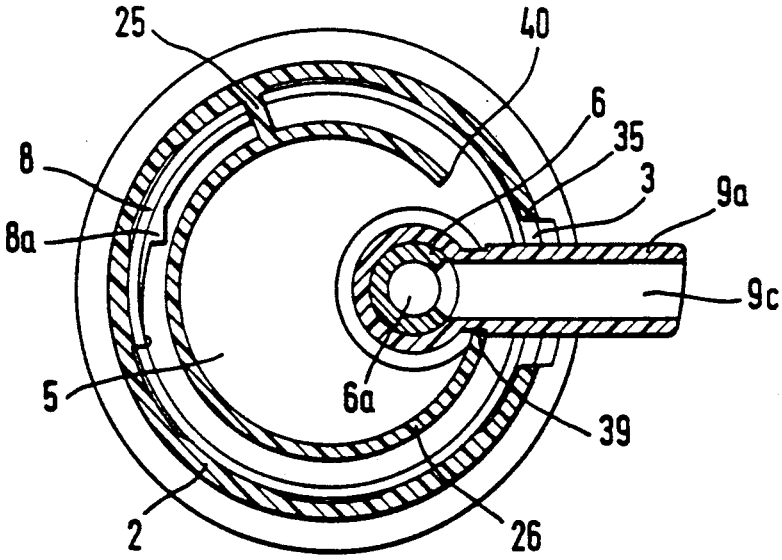

FIG.17
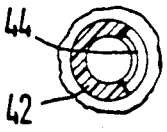
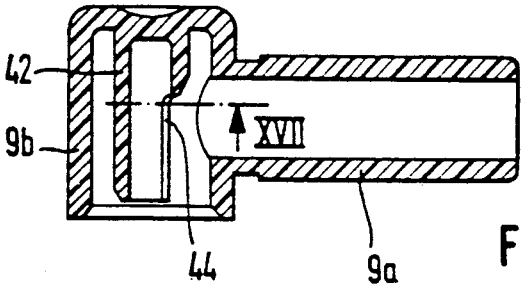
FIG.15
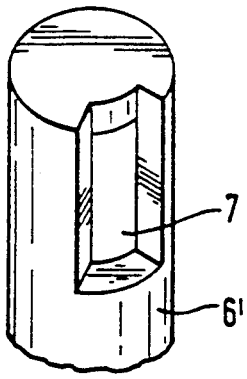
FIG.18
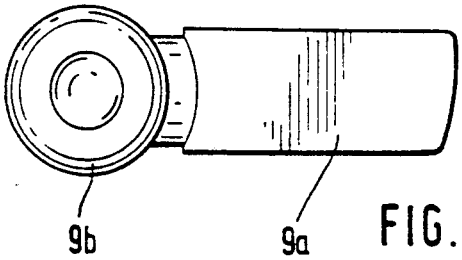
FIG.16
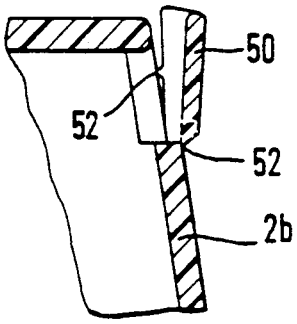
FIG.21
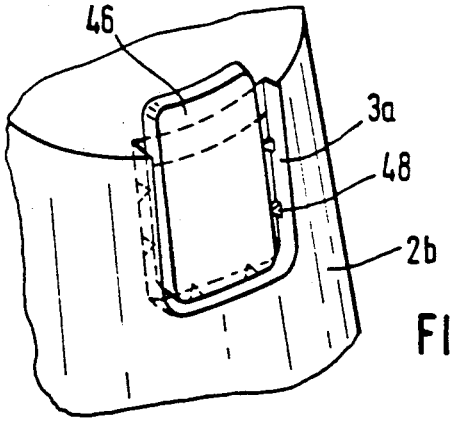
FIG.19
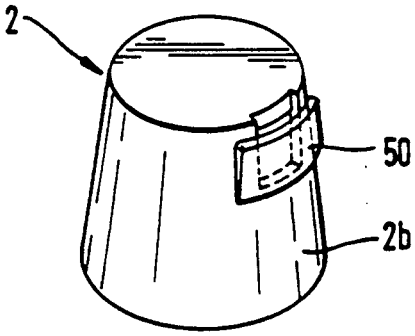
FIG.22
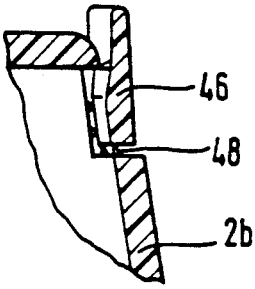
FIG.20

CONTAINER CLOSURE WITH A RETRACTABLE TURNSPOUT

BACKGROUND OF THE INVENTION

The invention relates to a closure of plastics material on a container (particularly a bottle) which serves to receive and deliver liquids or pastes. The closure of this container has a retractable turnspout.

Such a closure is disclosed in U.S. Pat. No. 3,847,313. The turnspout mentioned therein is rotatable about an eccentric bush. The tube of the turnspout can be moved outwardly or inwardly by way of a pivotal movement. In the one extreme position it disappears completely within an actuating cap. This is the closed position. In the other extreme position it projects to a maximum extent out of a lateral opening in the cap. This is the use position in which liquid can be delivered (poured or squirted) through the turnspout.

A valve in the liquid passage to the turnspout is so actuated that it is open in the use position and closed in the closed position. In the known closure an additional movement of the turnspout is necessary, namely parallel to the closure axis, to actuate the valve so that a plug, which is attached within the tube on the upper wall, can engage in a bush and close it and vice versa. A helical ramp on the plug base and guide curves extending inwardly from the cap base are necessary for this additional upward and downward movement of the turnspout. A relatively large number of components are thus necessary for the actuation of the turnspout in two directions which results in complicated injection molded components.

In addition to the inevitable friction due to the rotary movement of the cap and tube when actuating the turnspout, friction in the axial direction (tube against bush) and friction on the helical ramp also occur so that the closure can only be actuated with the application of considerable force and cannot be actuated at all by frail people.

The height matching of the components which is necessary for the pressing in and turning is difficult due to the great number of the height tolerances which occur. In this connection there are four components to be taken account of, namely the cap, tube, plug and mouth.

U.S. Pat. No. 3,371,827 discloses another container closure with a turnspout in which the turnspout needs only to be displaced in the direction of rotation. In one embodiment thereof (FIGS. 9 to 11) the free outer end of the turnspout may also be shut off, in fact by the actuating cap itself. In the closed position, not only the outer end of the tube but also its inner end are closed off. The tube itself is angled and its lower limb in the use position passes through the base of the closure plug and is pivotable in this base. A projection attached to the inner surface of the cap base serves to move the tube when the cap is rotated.

This has the following disadvantages:

The bent tube can be manufactured integrally of plastics material, only with the aid of a complicated mold, in an injection molding process.

When the closure plug is pressed in and the cap screwed on the cap wall is deformed and thus unsuitable for sealing the outer end of the tube.

The cap impedes the pivotal movement of the tube even at positions where no sealing is necessary, namely during the major portion of the pivotal movement.

A feed pipe for liquid cannot be fitted.

SUMMARY OF THE INVENTION

The present invention is to provide a container closure with a retractable turnspout of the type referred to in the above in which the diverse disadvantages mentioned above are avoided.

The result is substantially simpler injection molded components for actuating the turnspout by comparison with U.S. Pat. No. 3,847,313 since the turnspout need only be moved by the cap in the pivotal direction whilst components for raising and pressing down the turnspout are superfluous. Consequently, substantially less friction arises when actuating the closure in accordance with the invention.

By comparison with U.S. Pat. No. 3,371,827 the shield in accordance with the invention attached to the plug offers the advantage principally that the free end of the tube is sealed perfectly in the closed position whilst in accordance with this prior publication it only engages the cap without being sealed. A further advantage resides in that the fit between the outer end of the tube and the shield is not changed when the container is closed, that is to say a perfect sealing function is maintained.

In accordance with one aspect of the invention the shield, which serves to close the lateral opening in the cap and to seal the outer end of the tube may be additionally used to limit the rotation of the cap in at least one direction of rotation.

In-the opening direction this purpose can be served by one edge of the shield together with a projection on the interior of the cap wall.

A tamper indicator may be provided which this may be so constructed that the cap and tongue which may be broken away which are necessary for this purpose may be manufactured in a simply constructed injection molding tool.

In accordance with a further aspect of the invention the plug can be positioned in the direction of rotation when inserted into the mouth of the container. e.g. can be alined with respect to a bottle label.

In accordance with a further aspect of the invention in the closure position, the cap can be locked with respect to a rib provided at the outside of the container mouth.

BRIEF DESCRIPTION OF THE DRAWINGS

Exemplary embodiments with further features of the invention will be described below with reference to the drawings.

FIG. 6 is a view from below of the cap illustrated in FIG. 2.

FIG. 7 is an axial sectional view of the cap on the plane VII—VII in FIG. 6.

FIG. 8 is a partial axial section through the cap on the plane VIII—VIII in FIG. 6.

FIG. 9 is a longitudinal section through the container mouth, plug, cap and the turnspout which has been completely pivoted out and thus shows the use position.

FIG. 10 is a sectional view on the plane X—X in FIG. 9, that is to say viewed from above towards the plug base; the parts also being in the use position.

FIG. 15 is a longitudinal sectional view of a modified embodiment of a turnspout.

FIG. 16 is a plan view of this turnspout.

FIG. 17 is a partial sectional view on the plane XVII in FIG. 15.

FIG. 18 is a perspective view of another embodiment of the bush provided on the plug.

FIGS. 19 and 20 are a perspective view and a partial longitudinal sectional view through the cap, respectively, of a tamper-proof closure.

FIGS. 21 and 22 are similar views of another version of a tamper-proof closure.

DETAILED DESCRIPTION OF THE INVENTION

Terms such as "above" and "below" refer to the position of the parts in a vertically standing mouth of an upright container. Terms such as "axial" refer to the axes of the mouth and of the plug.

All components of the container closure are manufactured from plastics material.

FIGS. 1 to 4 show a closure 1 with a turnspout in accordance with the invention. Rotatably, secured to a container 4 is a cap 2 with cap base 2*a* and a cap wall 2*b* in which there is a lateral opening 3. The container is preferably elastically flexible.

Figure 1:
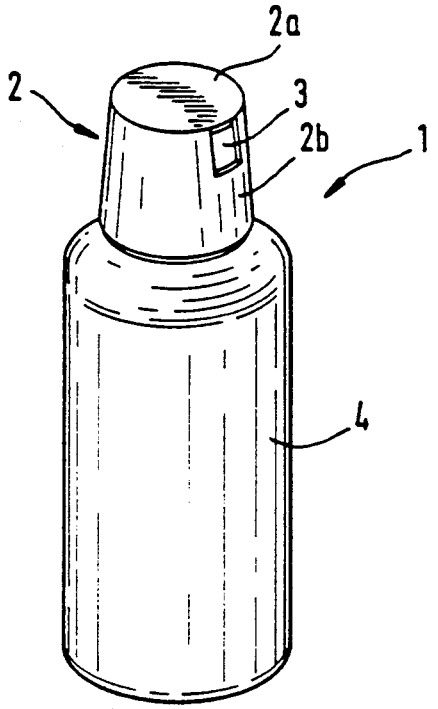
FIG. 1 is a perspective view of a closure with a retractable turnspout in accordance with the invention mounted on a container.
Figure 2:
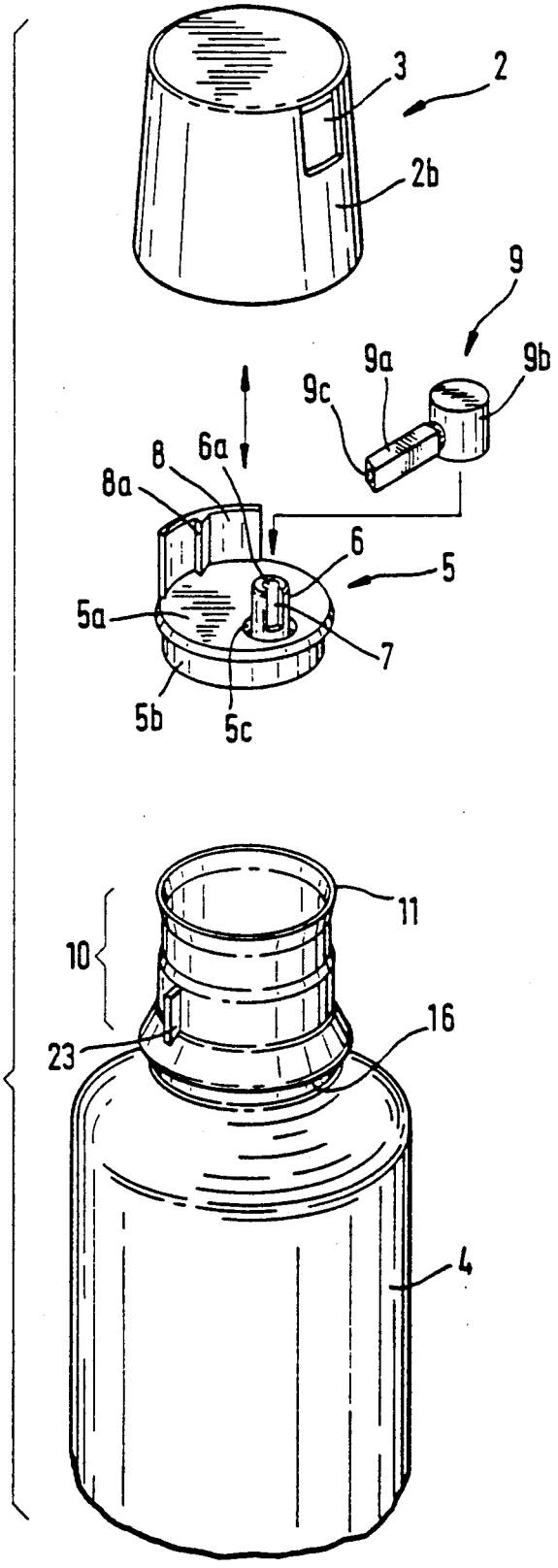
FIG. 2 is an exploded view on an enlarged scale of the container and the components of the closure.
Figure 3:
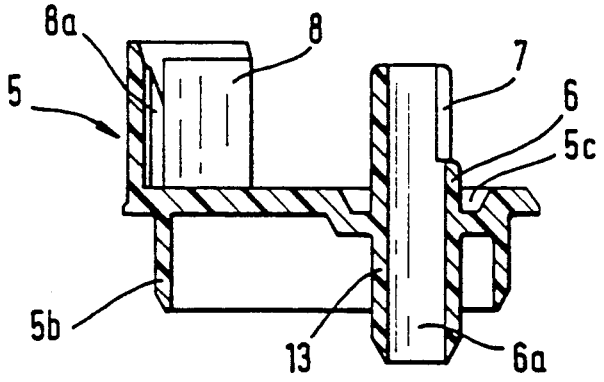
FIG. 3 is an axial section through the plug of the closure shown in the middle of FIG. 2.
Figure 4:
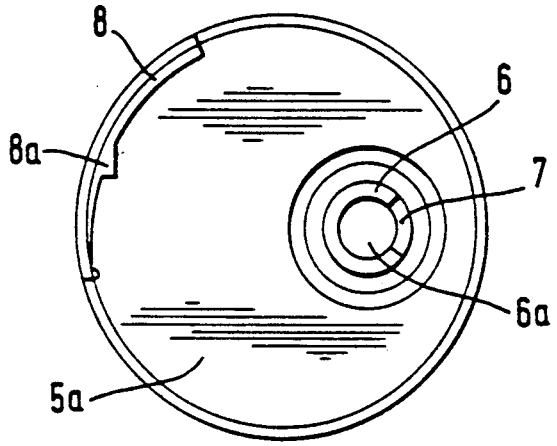
FIG. 4 is a plan view of the plug.
Figure 5:
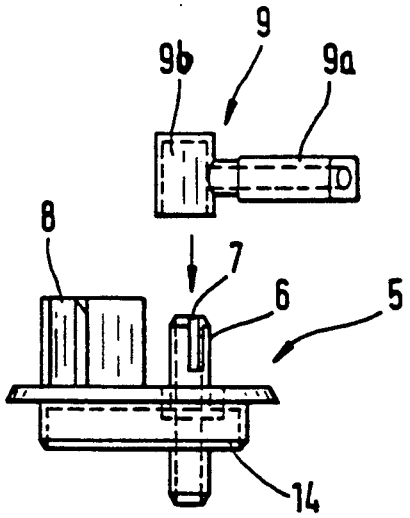
FIG. 5 is a side elevation of the plug with the turnspout on a reduced scale by comparison with FIGS. 3 and 4.
Figure 11:
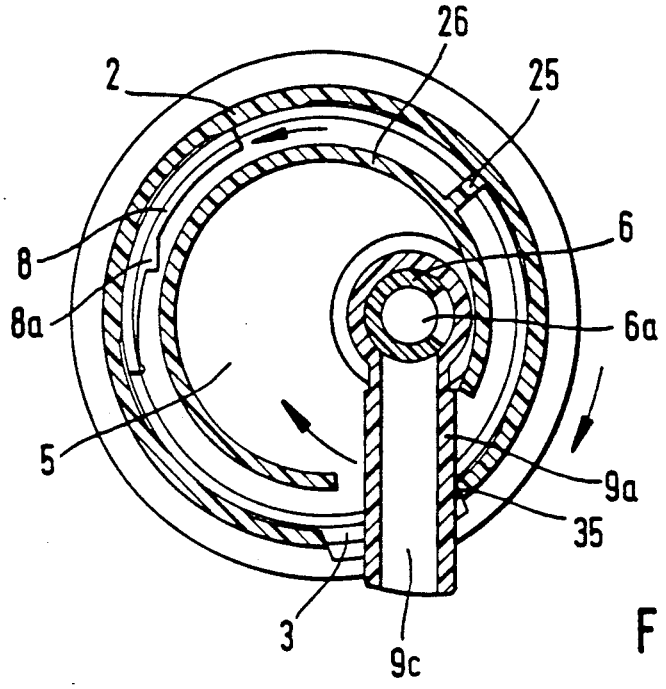
FIGS. 11 to 14 are views similar to FIG. 10 and show the relative positions of the components in differing rotary positions of the cap and the turnspout.

FIGS. 3 and 4 and the middle of FIG. 2 show a plug 5 with plug base 5*a* and a plug wall 5*b* extending upwardly therefrom for insertion of the plug into the container mouth 10. The plug is integrally injection molded with a bush 6 of relatively hard plastics material. The bush is situated substantially eccentrically and extends parallel to the plug axis. The lower end of the bush 6 is surrounded by an annular groove 5*c*. On its upwardly directed side the bush has a longitudinal slot 7 which is parallel to the axis and which merges into a liquid passage 6*a* in the interior of the bush. The upper end of the bush can also be closed, as is shown on a bush 6' in FIG. 18.

FIG. 2 also shows the turnspout which is designated in its entirety as 9 and which has a cap-like turret 9*b*, on which there is a radial tube 9*a* whose liquid passage 9*c* is in communication with the interior of the turret. After assembly, the turret sits on the bush 6, as shown in FIG. 9. It fits in a rotatable and sealing manner over the bush. When the tube 9*a* is pivoted fully outwardly, its liquid passage 9*c* is in communication through the longitudinal slot 7 with the liquid passage 6*a* in the bush 6. The longitudinal slot has the effect of a tap; when the tube 9*a* is pivoted inwardly (FIGS. 11 to 14) this connection is broken and when the tube is completely pivoted out (FIG. 10) it is open.

Figure 14:
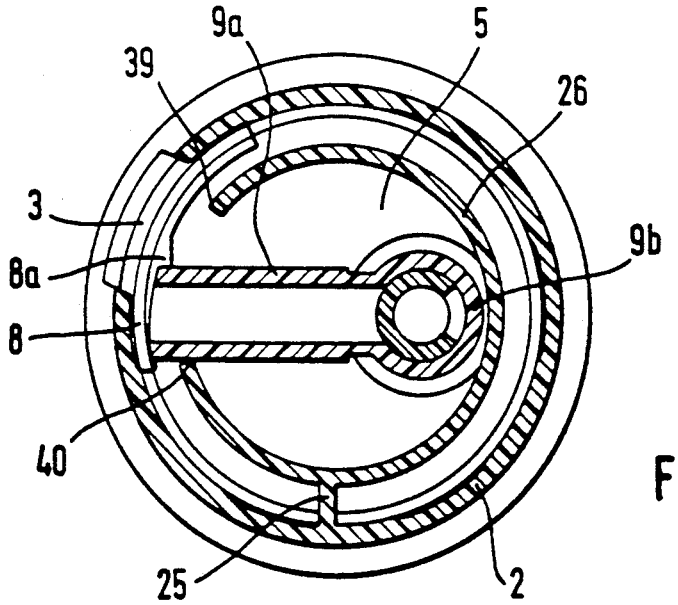

On the plug base there is a shield 8 which is constructed as a part-cylindrical wall integral with the plug and is concentric with the plug axis 5*d* (FIG. 9). It serves to close the lateral opening 3 in the cap in the closed position, as shown in FIG. 14. The shield also has other functions it has an inwardly directed abutment rib 8*a* which is parallel to the axis and which in the closed position serves as an abutment for the outer end of the tube (FIG. 14). The shield also serves in this position to seal the outer end of the tube 9*a*.

The edge of the plug base 5*a* rests on a lip 11 at the top of the container mouth 10. A bush 13 projects downwardly from the plug base 5*a*. A feed tube can, if required, be pushed onto it for the liquid which is to be delivered.

FIG. 6 shows the cap 2 from below on an enlarged scale. One can see the lateral opening 3 in the cap wall 2*b*. Lower snap lugs 17 serve to retain the cap 2 on the container mouth 10. They engage below a snap ring 16 on the container mouth and fix the cap against rotation on the container and secure against axial movements. Upper snap lugs 18 serve to fix the plug 5 with the turnspout 9 in position within the cap 2. After its engagement the plug sits rotationally fixed in the container mouth and thus does not move when the cap 2 rotates. By virtue of the wall 26 a precise height assembly of the plug 5 with the turnspout 9 in the cap 2 is rendered possible. The wall 26 transmits the axial force which is necessary for the engagement of the plug in the container mouth 10, from the cap 2 to the plug 5.

A flat abutment web 25 (FIGS. 6 and 8) which extends along a radial plane and projects from the cap base limits the rotary movement of the cap 2 in the use position by abutment against the shield 8 and thus the pivotal movement of the turnspout when its tube 9*a* is completely extended (FIG. 10). In this position the tube extends approximately in the direction of a radial plane. Fastened to the cap base is an inwardly directed cylindrical wall 26 which is however not completely closed but has an opening which is somewhat offset with respect to the lateral opening 3 in the cap and is defined by two edges, the "engaging edges" 39 and 40. The wall 26 serves to move the tube 9*a* in the one or the other direction of rotation and thus to pivot the tube outwardly into the use position (FIG. 10) and to pivot it inwardly into the closed position (FIG. 14), so long as the rotary movement is not limited by abutments.

Provided on the inner side of the cap wall 2*b* is a flat positioning web 24 (FIG. 8) which, when the plug 5 is inserted, serves together with the cap to position the plug in the direction of rotation, namely by abutment against a rib 23 on the container mouth 10 (FIG. 2). In this manner the plug can be aligned, e.g. with a bottle label or the like. The cap can be locked in the closed position with respect to the rib 23 on the opening by a short locking web 27 (FIG. 6) provided in the cap.

FIGS. 10 to 14 show in section on the plane X—X in FIG. 9 the position of the parts in differing pivotal positions. FIG. 10 shows the use position with the tube 9*a* completely pivoted out corresponding to FIG. 9 in which the container contents can be delivered. On rotation of the cap 2 in the clockwise sense out of the position of FIG. 10 into that of FIG. 12, the edge 35 of the lateral opening 3 in the cap moves the tube 9*a* with it in the clockwise sense. Thereafter the tube is moved into the closed position of FIG. 14 by an edge of the cylindrical wall 26, the "second engaging edge" 40, namely when it has been completely withdrawn inwardly out of the lateral opening 3 in the cap and as a result can no longer be moved by the edge 35 of the opening 3. In the closed position of FIG. 14 the outer end 9*a* of the tube is sealed with respect to the inner wall of the shield 8. The abutment rib 8*a* of the shield limits the movement of the tube and thus also the rotation of the cap 2 with respect to the container mouth.

When the tube is pivoted in from the position of FIG. 10 in the clockwise sense its liquid passage 9*c* is firstly shut off with respect to the longitudinal slot 7 in the bush 6. The inner end of the tube 9*a* is thus sealed. Only later, when in the position of FIG. 14, is its outer end also shut off by the shield 8.

The "first engaging edge" 39 of the cylindrical wall 26 serves to move the tube 9*a* in the opposite direction out of the position of FIG. 14 into that of FIG. 10. When the cap is pivoted in the anti-clockwise sense the engaging edge 39 engages the side wall of the tube 9*a*, pivots the tube firstly out of its sealing position with respect to the shield 8 and then further in the anti-clockwise sense so that after a certain pivotal movement it comes out of the lateral opening 3 in the cap 2 and finally moves into the position of FIG. 10 in which it projects by the maximum distance and again defines a continuous liquid passage, as shown in FIG. 9. The rotation of the cap 2 in the anti-clockwise sense is limited by abutment of the abutment web 25 on the cap with the one edge of the shield 8, as shown in FIG. 10.

In an embodiment shown in FIGS. 15 to 17, there is provided concentrically in the interior of the turret 9*b* for the purpose of additional sealing in the closed position a hollow cylinder 42 which after assembly sealingly engages in the liquid passage 6*a* of the bush. In its lower portion the hollow cylinder 42 has a longitudinal slot 44 which forms a liquid passage whose breadth corresponds to that of the longitudinal slot 7 in the bush 6 (FIG. 4). In the use position of FIG. 10 the longitudinal slot 44 permits an unimpeded liquid flow between the liquid passages 6*a* and 9*c*.

Figure 12:
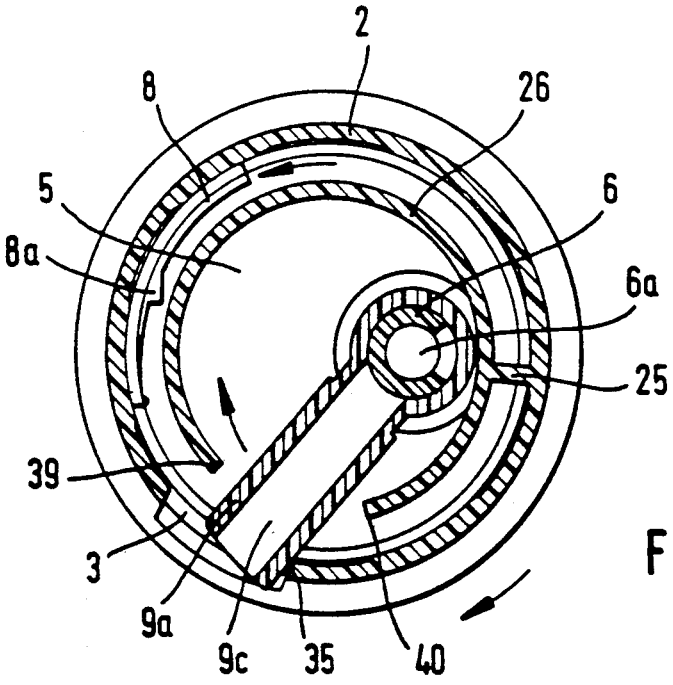
Figure 13:
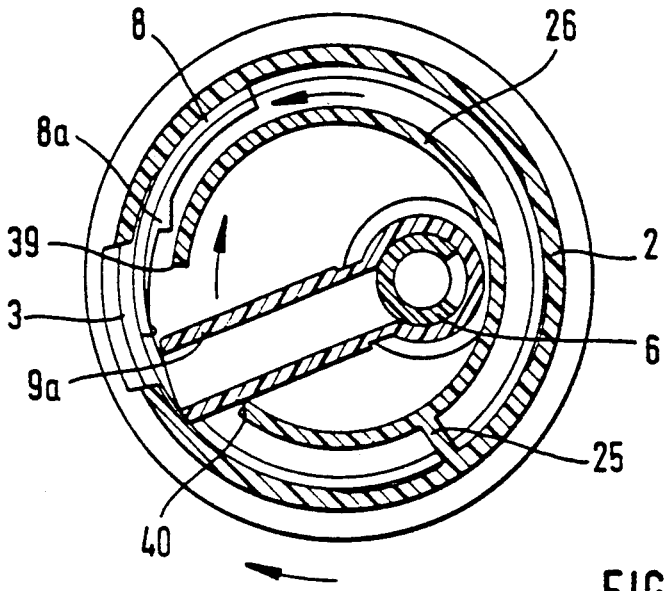

In the positions of FIGS. 12 to 14, the wall of the hollow cylinder 42 blocks this liquid flow and thus serves additionally to seal the inner end of the tube 9*a*.

As shown in FIGS. 19 and 20, to provide a tamper-proof closure the lateral opening 3 of the cap can be closed by an integrally molded tongue 46 which can be broken away. It is connected to the edges 3*a* of the opening 3 by means of web-like predetermined breaking points 48. p FIGS. 21 and 22 show another embodiment of a tamper-proof closure. The illustrated tongue 50 which may be torn away extends parallel to the axis of the cap 2 and is broader than the opening 3. It is connected to the cap wall 2*b* by means of predetermined breaking points 52. This embodiment has the advantage that the cap and tongue which may be torn away can be demolded without an additional movement of the injection mold.

I claim:

1. Container closure of plastics material for mounting on a container having a container mouth and a longitudinal axis, comprising;

a) a closure plug (5) rotationally fixedly inserted in the container mouth and having a plug base, b) an upwardly extending bush (6) which is eccentrically arranged on the plug base and having an internal passage passing through through the plug base, d) a turret (9*b*) which sealingly engages over the bush and is rotatable around an axis of rotation and which together with a tube (9*a*) projecting from said turret transverse to said axis of rotation forms a turnspout, d) a continuous liquid passage in the turret and tube, e) a sealing means between the bush (6) and turret (9*b*), f) a cap (2) which lockingly engages over the closure plug and the container mouth along said longitudinal axis, is rotatable with respect to the closure plug and has a lateral opening (3) through which the tube (9*a*) passages in an operational position and one edge (35) of which cap serves to move the tube out of the operational position, said cap having a cap base, and a cap axis g) a shield (8) upstanding from the plug base (5*a*) for closing the lateral opening when the turnspout (9) is pivoted toward a closed position, h) a wall (26) which is on the cap base (2*a*), projects towards the plug base (5*a*) and extends concentrically to cap axis and having a first engaging edge (39) which peripherally limits said wall with said first engaging edge pivoting the tube (9*a*) out into its operational position, wherein:

i) a longitudinal slot (7) is provided in the bush (6) which longitudinal slot together with an inward end of the liquid passage (9*c*) forms a tap, j) the shield (8) is partially cylindrical, has on its inner wall a projection (8*a*) for abutment by the free end of the tube and serves to limit the inward pivotal movement of the tube and the shield seals the free end of the tube (9*a*) when it has been pivoted to said closed position, k) the wall (26) projecting from the cap has towards the plug base has the shape, with the exception of an interruption, of a closed cylindrical wall whose outer diameter is somewhat smaller than the inner diameter of the shield (8), l) a first engaging side (39) is provided on the wall (26), and m) a second engaging (40) is provided on the wall (26) for pivoting the tube in towards the end of the inward pivotal movement until it is behind the shield in a predefined storage position.

2. Container closure as claimed in claim 1, wherein said sealing means comprises a hollow cylinder (42) mounted on a base of the turret (9*b*) which hollow cylinder fits concentrically and in a liquid-tight manner into said internal passage and has a longitudinal slot (44) which is directed towards the tube (9*a*).

3. Container closure as claimed in claim 1, characterised in that the interruption is situated between the two engaging edges (39,40) and approximately opposite the lateral opening (3) in the cap wall (2*b*).

4. Container closure as claimed in claim 1, wherein the shield (8) cap (2) includes cooperating means to limit the rotation of the cap, when a use position is reached.

5. Container closure as claimed in claim 4, wherein said cooperating means comprises a projection (25) arranged in the interior of the cap wall (2*b*) and one edge of the shield (8) which abut one another to terminate the rotation of the cap after the tube (9*a*) has been pivoted out.

6. Container closure as claimed in claim 1, characterised in that the lateral opening (3) in the cap (2) is closed before use to provide a tamper indicator by a frangible integrally molded tongue (46,50).

7. Container closure as claimed in claim 6, characterised in that the tongue extends parallel to the cap axis.

8. Container closure as claimed in claim 1, further comprising:

a) a positioning web (24) parallel to the axis provided on the inner surface of the cap wall (2,*b*), b) a rib (23) parallel to the axis provided on the outer surface of the container mouth (10), c) the positioning web aligning the closure plug (5) to a defined peripheral position when it is inserted in the container mouth.

9. Container closure as claimed in claim 8, characterised in that provided on the inner surface of the cap wall (2*b*) there is a locking web (27) which snaps over the upper end of the rib (23) on the container mouth when the cap reaches the closed position.

* * * * *